US010741321B2

(12) United States Patent
Kim et al.

(10) Patent No.: US 10,741,321 B2
(45) Date of Patent: Aug. 11, 2020

(54) THIN FILM TYPE INDUCTOR

(71) Applicant: SAMSUNG ELECTRO-MECHANICS CO., LTD., Suwon-si, Gyeonggi-do (KR)

(72) Inventors: Boum Seock Kim, Suwon-si (KR); Kang Wook Bong, Suwon-si (KR); Byeong Cheol Moon, Suwon-si (KR); Joung Gul Ryu, Suwon-si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 313 days.

(21) Appl. No.: 15/861,189

(22) Filed: Jan. 3, 2018

(65) Prior Publication Data

US 2019/0013143 A1 Jan. 10, 2019

(30) Foreign Application Priority Data

Jul. 5, 2017 (KR) ..... 10-2017-0085287

(51) Int. Cl.

| | |
|---|---|
| ***H01F 5/00*** | (2006.01) |
| ***H01F 27/28*** | (2006.01) |
| ***H01F 27/29*** | (2006.01) |
| ***H01F 27/255*** | (2006.01) |
| ***H01F 17/00*** | (2006.01) |

(52) U.S. Cl.

CPC ..... *H01F 27/2804* (2013.01); *H01F 17/0013* (2013.01); *H01F 27/255* (2013.01); *H01F 27/29* (2013.01); *H01F 27/292* (2013.01); *H01F 2017/002* (2013.01)

(58) Field of Classification Search

USPC ..... 336/200, 232, 192, 83

See application file for complete search history.

(56) References Cited

U.S. PATENT DOCUMENTS

2016/0111194 A1* 4/2016 Jeong ..... H01F 17/0013 336/200
2016/0343499 A1 11/2016 Nakamura et al.
2018/0286561 A1* 10/2018 Shimoichi ..... H01F 17/0013

FOREIGN PATENT DOCUMENTS

JP 11-204337 7/1999
JP 5445884 B2 3/2014
JP 2016-001734 A 1/2016

* cited by examiner

*Primary Examiner* — Elvin G Enad
*Assistant Examiner* — Kazi S Hossain
(74) *Attorney, Agent, or Firm* — Morgan, Lewis & Bockius LLP

(57) ABSTRACT

A thin film type inductor includes first, second and third exposed portions exposed to a first end surface of a body and fourth, fifth and sixth exposed portions exposed to a second end surface of the body opposing the first end surface of the body among external surfaces of the body. The first, second and third exposed portions are formed to be exposed symmetrically to the fourth, fifth and sixth exposed portions opposing the first, second and third exposed portions, respectively.

15 Claims, 4 Drawing Sheets

I-I'

II-II'

III-III'

IV-IV'

THIN FILM TYPE INDUCTOR

CROSS-REFERENCE TO RELATED APPLICATION(S)

This application claims the benefit of priority to Korean Patent Application No. 10-2017-0085287, filed on Jul. 5, 2017 in the Korean Intellectual Property Office, the disclosure of which is incorporated herein by reference in its entirety.

BACKGROUND

1. Field

The present disclosure relates to a thin film type inductor, and more particularly, to a thin film type inductor having a chip structure.

2. Description of Related Art

In accordance with the development of information technology (IT), the miniaturization and thinning of various electronic devices has been accelerated, and thus, the miniaturization and thinning of thin film type inductors used in such electronic devices have been required.

In order to manufacture a thin film type power inductor having a small size and high inductance, a coil having a high aspect ratio and a magnetic sheet having a high filling factor may be stacked in a body. However, when incorporating a coil having a fine line width and implementing a high aspect ratio within a body material capable of being highly filled, the coil may have a low degree of rigidity due to the fine line width, and the magnetic sheet, having a high filling factor, provided to implement a highly filled body may have a high degree of flowability. Hence, at the time of compressing and curing the body when forming the body, deformation of the body may occur, and thus, a dicing defect, or the like, may occur, deteriorating the reliability of the finished product.

SUMMARY

An aspect of the present disclosure may provide a thin film type inductor capable of significantly decreasing deformation of a body at the time of manufacturing a chip to improve reliability.

According to an aspect of the present disclosure, a thin film type inductor may include: a body; and first and second external electrodes disposed on an external surface of the body. The body may include a support member including a through hole, upper and lower coils supported by the support member, and a magnetic material encapsulating the support member and the upper and lower coils. The support member may include first and second via portions opposing each other. First to third exposed portions spaced apart from each other by a predetermined interval and fourth to sixth exposed portions spaced apart from each other by a predetermined interval may be exposed to first and second end surfaces of the body opposing each other, respectively.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will be described in detail with reference to the accompanying drawings.

Hereinafter, a thin film type inductor according to an exemplary embodiment in the present disclosure will be described, but is not necessarily limited thereto.

Figure 1:
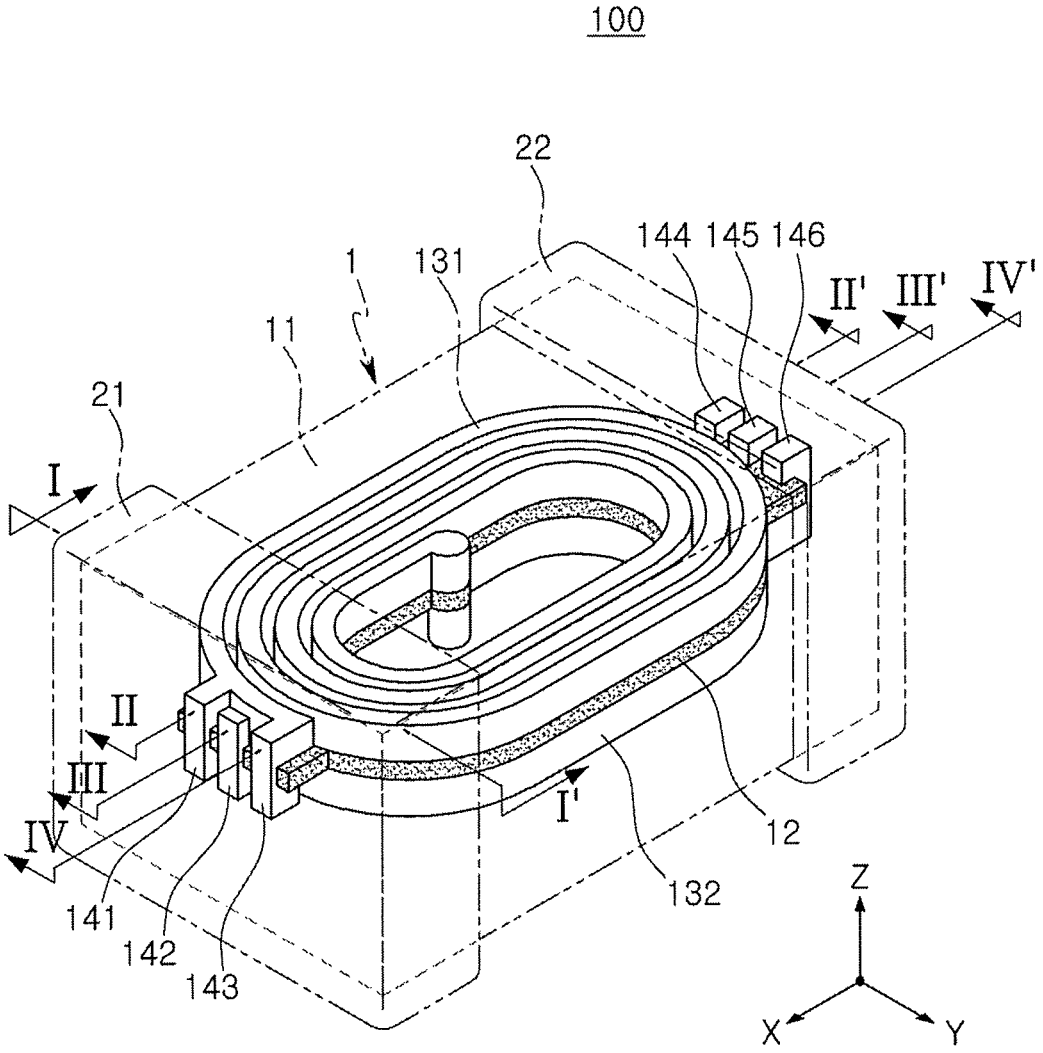
FIG. 1 is a schematic perspective view illustrating a thin film type inductor according to an exemplary embodiment in the present disclosure.
Figure 2:
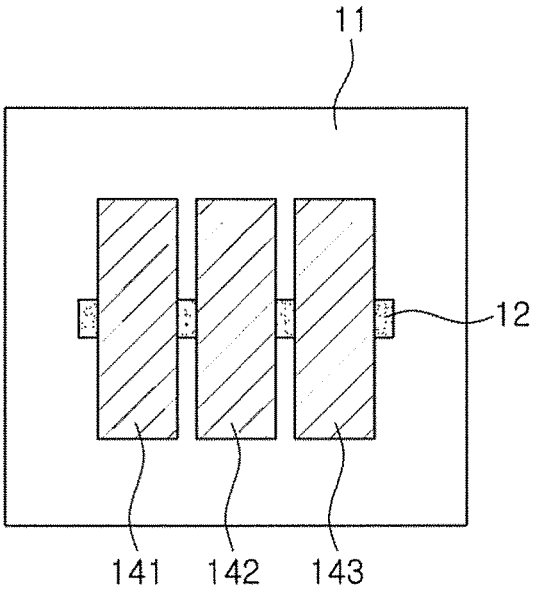
FIG. 2 is a schematic cross sectional view illustrating an exposed surface taken along line I-I' of FIG. 1.
Figure 3:
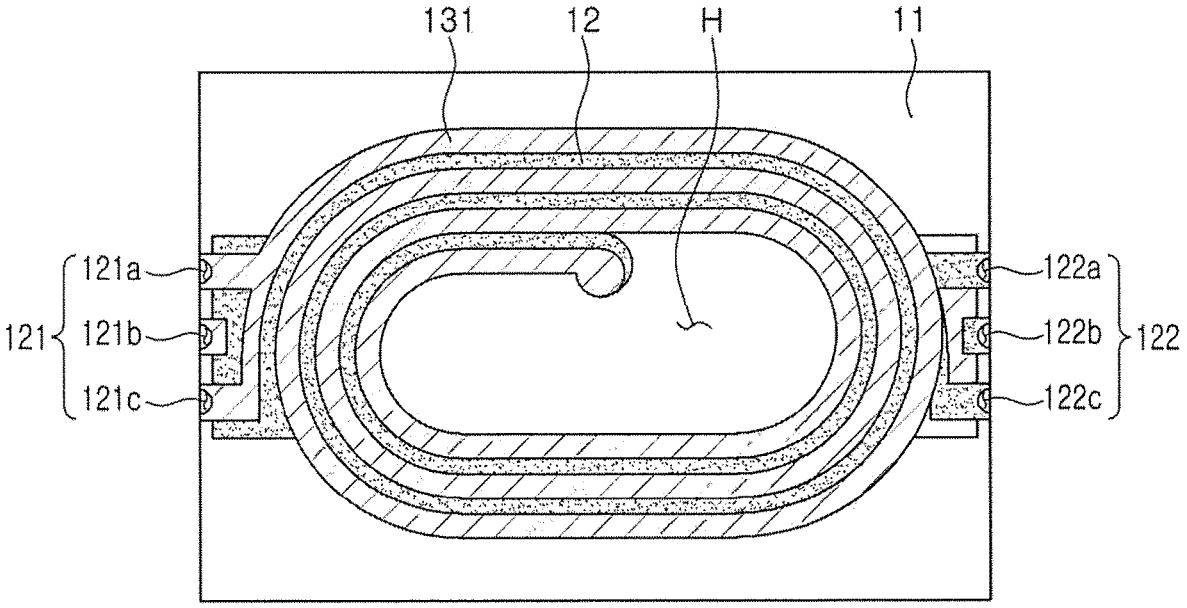
FIG. 3 is a schematic top view of a support member of FIG. 1.

FIG. 1 is a schematic perspective view illustrating a thin film type inductor according to an exemplary embodiment in the present disclosure, FIG. 2 is a schematic cross sectional view illustrating an exposed surface taken along line I-I' of FIG. 1, and FIG. 3 is a schematic top view of a support member of FIG. 1.

Referring to FIGS. 1 through 3, a thin film type inductor 100 according to the exemplary embodiment in the present disclosure may include a body 1 forming an exterior and first and second external electrodes 21 and 22 disposed on an external surface of the body.

Since the first and second external electrodes 21 and 22 need to be electrically connected to a coil in the body, the first and second external electrodes 21 and 22 may contain a material having excellent electric conductivity. The first and second external electrodes may be composed of a plurality of layers, and a material and a size of each of the layers may be suitably selected by those skilled in the art. Although a case in which the first and second external electrodes have a C shape is illustrated in FIG. 1, but the shape of the first and second external electrodes is not limited. For example, the first and second external electrodes may have an L shape, or the like.

The body 1 may form an entire exterior of the thin film type inductor and have upper and lower surfaces opposing each other in a thickness (T) direction, first and second end surfaces opposing each other in a length (L) direction, and first and second side surfaces opposing each other in a width (W) direction to have a substantially hexahedral shape. However, the body 1 is not is not limited thereto.

The first end surface of the body 1 will be described in detail with reference to FIG. 2. First, second and third exposed portions 141, 142 and 143 formed of a conductive material maybe exposed to the first end surface. Substantially, the first and third exposed portions 141 and 143 may be integrally connected to the upper coil 131, such that the upper coil 131 and the first and third exposed portions 141 and 143 are not distinguished from each other. On the contrary, since the second exposed portion 142 is not directly connected to the upper coil but is exposed to the first end surface to thereby be connected to the first external electrode 21, the second exposed portion 142 may be considered as a dummy pattern for the upper coil 131. A cross-sectional shape of each of the first to third exposed portions 141 to 143 may be a rectangular strip, but is not limited thereto. That is, the cross-sectional shape may be a trapezoidal strip of which a width of an upper or lower portion is wider, or a shape with a curved edge. The first to third exposed portions 141 to 143 may be disposed to be spaced apart from each other in the width direction, and a spaced distance therebetween may be suitably selected by those skilled in the art. Although not illustrated in detail, fourth to sixth exposed portions 144 to 146 may be exposed to the second end surface of the body, and a description for the first to third exposed portions 141 to 143 may be applied to the fourth to sixth exposed portions 144 to 146 as it is. The fourth to sixth exposed portions 144 to 146 may be disposed to be spaced apart from each other in the width direction by a predetermined interval, and among them, the fourth and sixth exposed portions 144 and 146 may be integrally extended from the lower coil, and the fifth exposed portion 145 may be interposed between the fourth and sixth exposed portions 144 and 146 in the width direction. The fifth exposed portion 145 is not formed integrally with the lower coil 132, but may be directly connected to the second external electrode 22.

The body 1 may include the magnetic material 11. For example, the body 1 may be formed by filling ferrite or a metal based soft magnetic material. An example of the ferrite may include ferrite known in the art such as Mn—Zn based ferrite, Ni—Zn based ferrite, Ni—Zn—Cu based ferrite, Mn—Mg based ferrite, Ba based ferrite, Li based ferrite, or the like. The metal based soft magnetic material may be an alloy containing at least one selected from the group consisting of Fe, Si, Cr, Al, and Ni. For example, the metal based soft magnetic material may contain Fe—Si—B—Cr based amorphous metal particles, but is not limited thereto. The metal based soft magnetic material may have a particle diameter of 0.1 μm or more to 20 μm or less and may be contained in a form in which the metal based soft magnetic material is dispersed in a polymer such as an epoxy resin, polyimide, or the like.

The body 1 may include the support member 12 therein. Describing the support member 12 in detail with reference to FIG. 3, the support member 12 may include a through hole H formed in a central portion thereof, and the magnetic material may be filled in the through hole. Permeability may be significantly improved by the magnetic material in the through hole. The support member 12 may include first and second via portions 121 and 122 disposed to oppose each other in the length direction. The first via portion may be disposed on one end surface of the support member, and the second via portion may be disposed on the other end surface of the support member opposing one surface of the support member in the length direction. The first and second via portions 121 and 122 may include a plurality of via holes 121*a*, 121*b*, and 121*c* and a plurality of via holes 122*a*, 122*b*, and 122*c*, respectively. The plurality of via holes 121*a* to 121*c* included in the first via portion may be disposed on one end surface of the support member to be spaced apart from each other in the width direction of the body, and the plurality of via holes 122*a* to 122*c* included in the second via portion may be disposed on the other end surface of the support member to be spaced apart from each other in the width direction of the body.

Generally, a support member includes a single via hole for electrically connecting coils on upper and lower surfaces of the support member to each other. However, since the thin film type inductor according to the present disclosure includes the plurality of via holes, at the time of compressing and curing magnetic sheets on and below the support member supporting the coil, deformation of the body may be prevented, and since the upper and lower coils may be more stably connected to each other by a conductive material filled in the via holes, distortion of the coil may be prevented. Further, since the plurality of via holes are filled with the conductive material, a contact property with the external electrodes connected thereto may also be improved.

Preferably, a diameter of each of the via holes in the first and second via portions may be 30 μm or more to 100 μm or less. When the diameter is smaller than 30 μm, it may be difficult to precisely process the via hole, an effect of filling the conductive material in the via hole may not be substantially implemented, and when the diameter is larger than 100 μm, it may be difficult to implement a coil with a plurality of turns in a restricted chip size.

The first and second via portions may be formed by a laser or CNC drilling, and suitable numbers and positions of via holes, and the like, may be freely set by those skilled in the art depending on manufacturing conditions and purposes.

Although not illustrated in detail, each of the via holes of the first and second via portions may include a seed layer therein, and preferably, the seed layer may be formed by a chemical copper plating method. Alternatively, the seed layer may be formed by depositing Mo, Ti, W, or the like, capable of being disposed by a sputtering method.

Although a case in which a cross-sectional shape of the via holes in the first and second via portions is a circular shape is illustrated in FIG. 3, but the cross-sectional shape is not limited thereto. The cross-sectional shape may be suitably selected from a diamond shape, a tetragonal shape, an oval shape, and the like. When the cross-sectional shape is not the circular shape, the diameter of the via hole may be defined as a distance in a straight line in a direction in which the straight line occupies the largest space in the cross-sectional shape.

Figure 4:
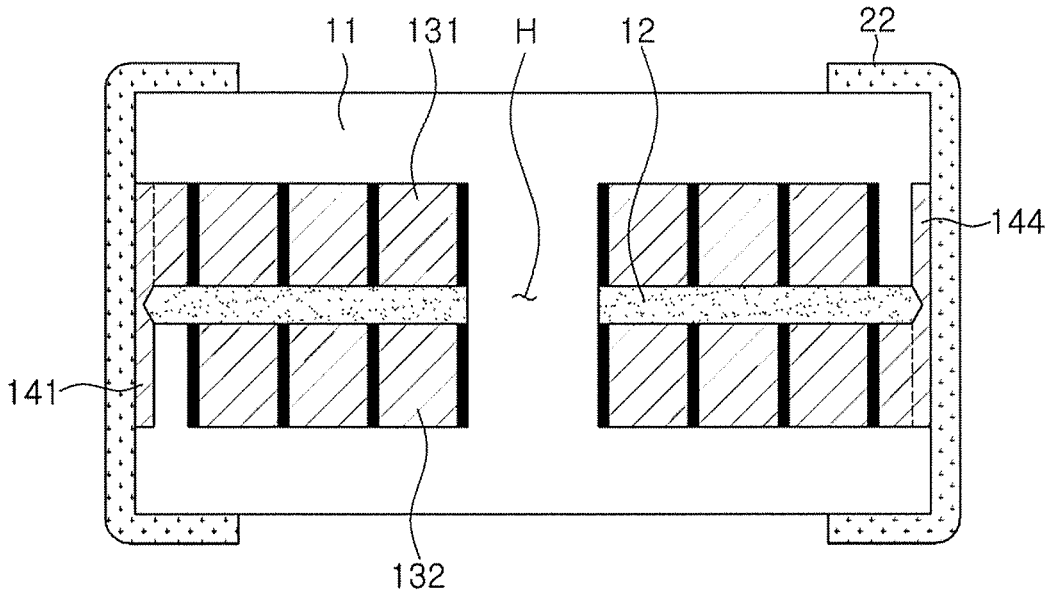
FIG. 4 is a cross sectional view illustrating an L-T cross section taken along line II-II' of FIG. 1.
Figure 5:
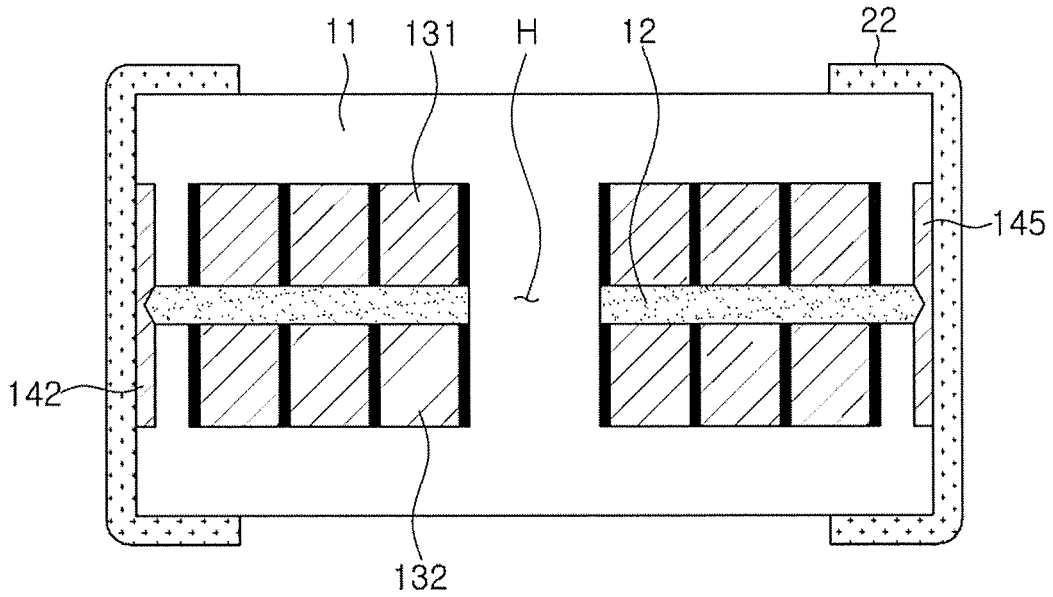
FIG. 5 is a cross sectional view illustrating an L-T cross section taken along line III-III' of FIG. 1.
Figure 6:
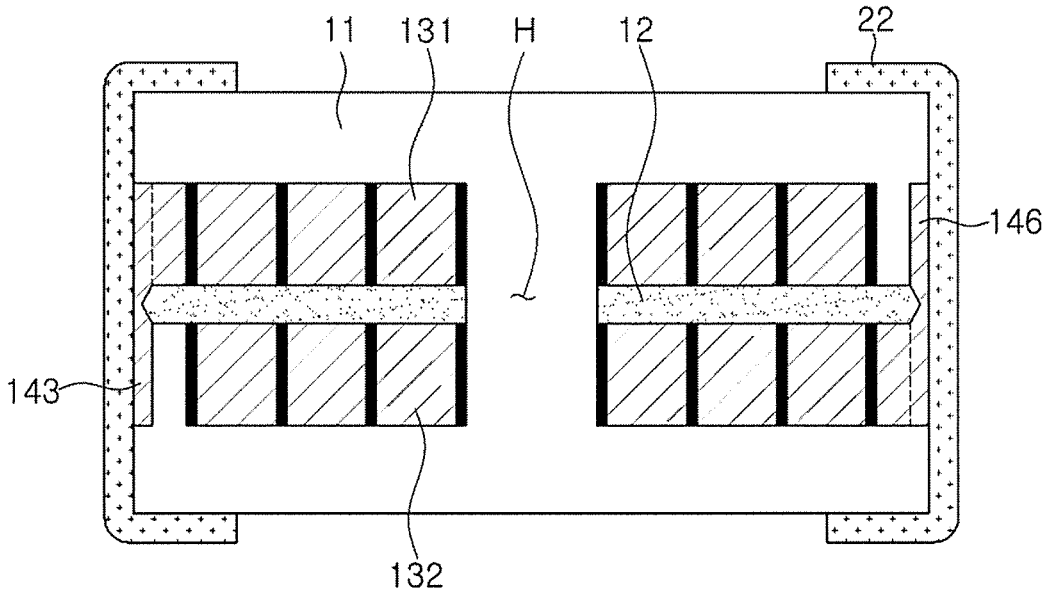
FIG. 6 is a cross sectional view illustrating an L-T cross section taken along line IV-IV' of FIG. 1.

Next, FIGS. 4 through 6 are cross sectional views illustrating L-T cross sections taken along lines II-II', III-III', and IV-IV' of FIG. 1, respectively. An internal structure of the body will be described in more detail with reference to FIGS. 4 through 6.

First, referring to FIG. 4, the first and second via portions may be formed at both end portions of the support member 12. Particularly, the support member 12 may include the via hole 121*a* of the first via portion and the via hole 122*a* of the second via portion. The first exposed portion 141 may penetrate through the via hole 121*a* of the first via portion. Since a length of the first exposed portion in the thickness direction is greater than a thickness of the upper or lower coil, a contact area between the first external electrode and the coil may be significantly increased. Similarly, the fourth exposed portion 144 portion may penetrate through the via hole 122*a* of the second via. Since a length of the fourth exposed portion 144 in the thickness direction is greater than the thickness of the upper or lower coil, a contact area between the second external electrode 22 and the coil may be significantly increased. As a result, a coupling degree between the first and second external electrodes and the coil may be improved, such that reliability may be improved. As illustrated in FIG. 4, the first exposed portion may be directly connected to one end portion of the upper coil, and the fourth exposed portion may be directly connected to one end portion of the lower coil. As a result, a possibility that problems such as distortion or collapse of the coil, shape deformation, and the like, will occur may be significantly decreased.

Next, referring to FIG. 5, the first and second via portions may be formed at both end portions of the support member 12. Particularly, the support member 12 may include the via hole 121*b* of the first via portion and the via hole 122*b* of the second via portion. The second exposed portion 142 may penetrate through the via hole 121*b* of the first via portion, and the fifth exposed portion 145 may penetrate through the via hole 122*b* of the second via portion. A length of each of the second and fifth exposed portions in the thickness direction may be greater than the thickness of the upper or lower coil. Since the second and fifth exposed portions are disposed to be spaced apart from the upper and lower coils, respectively, the second and fifth exposed portions may substantially serve as dummy patterns for reliable connection with the first and second external electrodes, but the contact area between the first external electrode and the coil and the contact area between the second external electrode and the coil may be significantly increased by the second and fifth exposed portions. The first end portion of the upper coil may be spaced apart from the second exposed portion by an insulator, and the second end portion of the lower coil may be spaced apart from the fifth exposed portion by an insulator.

Next, referring to FIG. 6, the first and second via portions may be formed at both end portions of the support member 12. Particularly, the support member 12 may include the via hole 121*c* of the first via portion and the via hole 122*c* of the second via portion. The third exposed portion 143 may penetrate through the via hole 121*c* of the first via portion, and the sixth exposed portion 146 may penetrate through the via hole 122*c* of the second via portion. Since a length of the third exposed portion in the thickness direction is greater than the thickness of the upper or lower coil, the contact area between the first external electrode and the coil may be significantly increased. Similarly, the sixth exposed portion 146 may penetrate through the via hole 122*c* of the second via portion. Since a length of the sixth exposed portion in the thickness direction is greater than the thickness of the upper or lower coil, the contact area between the second external electrode and the coil may be significantly increased. As a result, a coupling degree between the first and second external electrodes and the coil may be improved, such that reliability may be improved. As illustrated in FIG. 6, the third exposed portion may be directly connected to one end portion of the upper coil, and the sixth exposed portion may be directly connected to one end portion of the lower coil. As a result, a possibility that problems such as distortion or collapse of the coil, shape deformation, and the like, will occur may be significantly decreased.

Except for the description described above, a description of features overlapping those of the above-mentioned thin film type inductor according to the exemplary embodiment in the present disclosure will be omitted.

As set forth above, according to exemplary embodiments in the present disclosure, at the time of strongly compressing highly filled magnetic sheets to form the body, deformation of the exterior may be prevented, and distortion of the coil may be prevented. Further, electrical properties such as direct current resistance (Rdc), or the like, or close adhesion may be improved by increasing the contact area between the external electrodes and the coil disposed in the thin film type inductor.

While exemplary embodiments have been shown and described above, it will be apparent to those skilled in the art that modifications and variations could be made without departing from the scope of the present invention as defined by the appended claims.

What is claimed is:

1. A thin film type inductor comprising:

a body including a support member including a through hole, upper and lower coils disposed directly on upper and, lower surfaces of the support member, respectively, each having first and second end portions, and a magnetic material encapsulating the support member and the upper and lower coils; and first and second external electrodes disposed on an external surface of the body, wherein the body has upper and lower surfaces opposing each other in a thickness direction of the body, first and second end surfaces opposing each other in a length direction of the body, and first and second side surfaces opposing each other in a width direction of the body, the support member includes first and second via portions disposed at opposite sides in the length direction, first, second and third exposed portions formed of a conductive material are sequentially disposed in the width direction of the body to be exposed to the first end surface of the body, fourth, fifth and sixth exposed portions formed of a conductive material are sequentially disposed in the width direction of the body to be exposed to the second end surface of the body, and the second exposed portion or the fifth exposed portion is electrically insulated from the upper coil or the lower coil, respectively, to serve as a dummy pattern.

2. The thin film type inductor of claim 1, wherein the first, second and third exposed portions are electrically connected to the first external electrode, and the fourth, fifth and sixth exposed portions are electrically connected to the second external electrode.

3. The thin film type inductor of claim 1, wherein the magnetic material is provided in the through hole.

4. The thin film type inductor of claim 1, wherein the first, second and third exposed portions are spaced apart from each other in the width direction of the body, and each of the first, second and third exposed portions has a shape of a strip extended in the thickness direction of the body.

5. The thin film type inductor of claim 4, wherein a length of each of the first, second and third exposed portions in the thickness direction is greater than a thickness of the first end portion of the upper coil.

6. The thin film type inductor of claim 1, wherein the fourth, fifth and sixth exposed portions are spaced apart from each other in the width direction of the body, and each of the fourth, fifth and sixth exposed portions has a shape of a strip extended in the thickness direction of the body.

7. The thin film type inductor of claim 6, wherein a length of each of the fourth, fifth and sixth exposed portions in the thickness direction is greater than a thickness of the second end portion of the lower coil.

8. The thin film type inductor of claim 1, wherein the first, second and third exposed portions are exposed symmetrically to the fourth, fifth and sixth exposed portions in the length direction of the body, respectively.

9. The thin film type inductor of claim 1, wherein the first end portion of the upper coil is directly connected to the first and third exposed portions.

10. The thin film type inductor of claim 1, wherein the second end portion of the lower coil is directly connected to the fourth and sixth exposed portions.

11. The thin film type inductor of claim 1, wherein the first end portion of the upper coil is spaced apart from the second exposed portion by an insulator, and the second end portion of the lower coil is spaced apart from the fifth exposed portion by an insulator.

12. The thin film type inductor of claim 1, wherein the first via portion includes a plurality of via holes, and the plurality of via holes include a via hole filled with the first exposed portion, a via hole filled with the second exposed portion, and a via hole filled with the third exposed portion.

13. The thin film type inductor of claim 1, wherein the second via portion includes a plurality of via holes, and the plurality of via holes include a via hole filled with the fourth exposed portion, a via hole filled with the fifth exposed portion, and a via hole filled with the sixth exposed portion.

14. The thin film type inductor of claim 1, wherein the magnetic material is interposed in a space between the second exposed portion and the coil and a space between the fifth exposed portion and the coil.

15. The thin film type inductor of claim 1, wherein the first and second via portions include a plurality of via holes, and each of the via holes has a diameter of 30 μm or more to 100 μm or less.

* * * * *